United States Patent [19]

Ade

[11] 4,041,897

[45] Aug. 16, 1977

[54] CASCADE COATER

[75] Inventor: Frank Ade, Fribourg, Switzerland

[73] Assignee: Ciba-Geigy AG, Basel, Switzerland

[21] Appl. No.: 684,693

[22] Filed: May 10, 1976

[30] Foreign Application Priority Data

May 14, 1975 Switzerland ..... 6195/75

[51] Int. Cl.[2] ..... B05C 5/00

[52] U.S. Cl. ..... 118/300; 118/DIG. 4; 118/325; 427/420

[58] Field of Search ..... 118/DIG. 4, 300, 313, 118/314, 324, 325, 24, 50, 410, 411, 412; 427/131, 420; 137/101.27, 625.28; 62/175, 335

[56] References Cited

U.S. PATENT DOCUMENTS

| | | | |
|---|---|---|---|
| 3,508,947 | 4/1970 | Hughes | 118/DIG. 4 |
| 3,867,901 | 2/1975 | Greiller | 118/DIG. 4 |
| 3,920,862 | 11/1975 | Damschroder | 427/420 X |
| 3,973,062 | 8/1976 | Fahrni | 427/420 |

*Primary Examiner*—Louis K. Rimrodt
*Attorney, Agent, or Firm*—Harry Falber

[57] ABSTRACT

A cascade coater having a slideway and extending therein a slot which widens in the downstream direction as it meets the associated slideway. The slot is formed by upstream and downstream boundary walls, the downstream wall joining with a flat face angled with respect to that wall and the surface of the slideway or being curved to meet the slideway. The upstream and downstream surfaces of the slideway can lie in the same plane or different planes which are parallel and spaced apart by a distance of about 1 mm.

4 Claims, 4 Drawing Figures

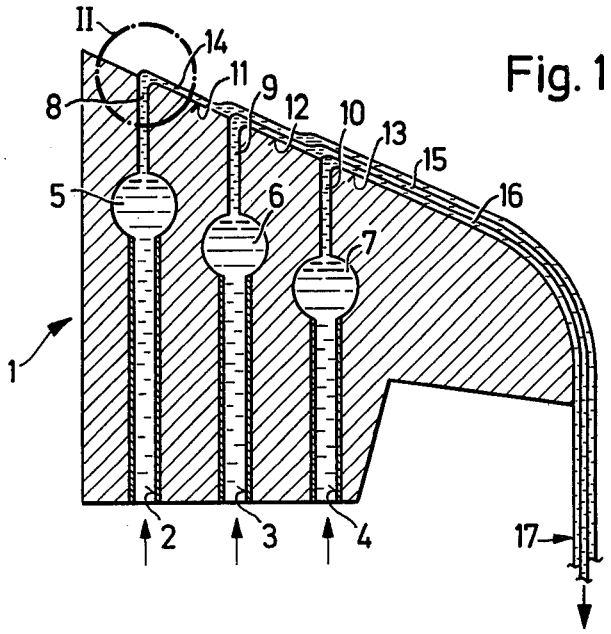
Fig. 1
Fig. 2
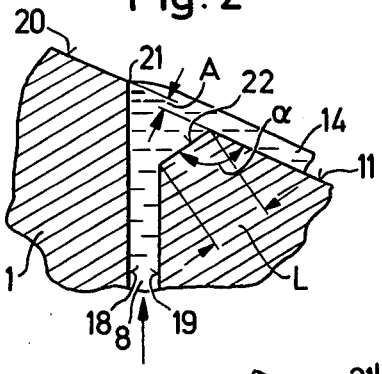
Fig. 3
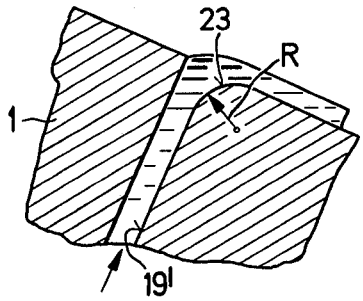
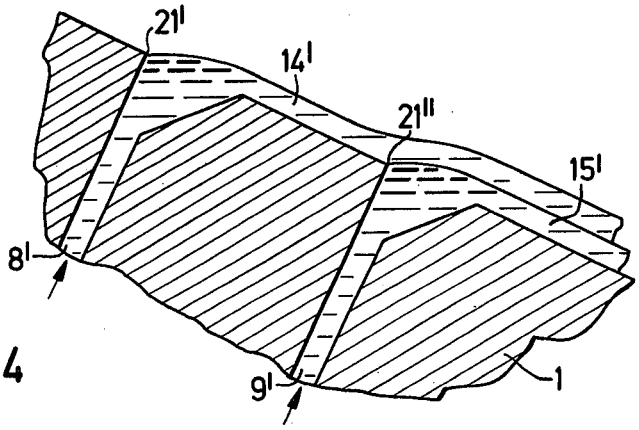
Fig. 4

CASCADE COATER

FIELD OF INVENTION

The invention relates to a cascade coater having at least one slideway into which extend a plurality of feed slots, each slot having an upstream and a downstream boundary wall.

PRIOR ART

In German Auslegeschrifts Nos. 1 216 686 and 1 752 885 a cascade coater is described which is used for coating a base material with photographic emulsions by the cascade or curtain coating method. The emulsion or emulsions are applied in the form of a free-falling liquid curtain having a single layer or a number of layers, to the base material which moves past the applicator.

The coating liquids which in such coaters issue from discrete feed slots on to associated slideways form wetting boundaries at the upstream boundary walls of the slot concerned and experience shows that the wetting boundaries are a main factor in determining coating uniformity, boundary irregularities leading to irregularities in the thickness of the or each layer of the coated material.

On the whole there are few difficulties in boundary line formation at the upstream boundary walls of the downstream slots (as considered in the direction of coating flow) but it is difficult to devise a satisfactory wetting boundary at the first or top slot, mainly because, unlike all the other feed slots, the wetting boundary of the top slot is in contact with the atmosphere. There is a risk, more particularly if the upstream slot edge is a little higher than the downstream edge or the surface of the associated slideway, of the coating liquid spreading out over the upstream slot edge and thickening or possibly even drying. Experience shows that this phenomenon does not occur uniformly over the whole width of the coater and leads to irregularities in the wetting boundary, with subsequent irregularities in coating thickness.

A way of obviating this difficulty is to make the upstream edge of the top slot considerably higher than the downstream edge thereof, the height difference being at least approximately 1 to 3 mm. This step ensures that the top wetting boundary is formed satisfactorily but unfortunately it is not always suitable, for example, when as is often required in practice, a single multiple cascade coater has to be used to apply different numbers of coatings. Usually cases in which the number of coatings required is less than the maximum number of feed slots of a particular cascade coater, the liquid layer which is to form the top coating issues not from the topmost feed slot but from a feed slot which is positioned lower down so that the wetting boundary difficulties occur here too. To obviate such difficulties, each slot should have a relatively much higher upstream edge as does the topmost slot; unfortunately, stepping of consecutive slideways leads to disturbances when the discrete layers of liquid flow over one another and considerably impair coating quality. In practice the known cascade coaters can therefore be used only for a fixed number of layers. Any change in the number of layers to be applied makes it necessary either to make constructional changes to the coater or to change the complete apparatus.

OBJECT OF INVENTION

It is therefore an object of the invention to provide a cascade coater which provides a solution to the problems associated with the formation of satisfactory wetting boundaries and which can be used to apply any number of coatings up to a maximum number determined by the number of slots but which requires no constructional changes when the number of layers to be coated is changed.

BRIEF REVIEW OF INVENTION

According to the invention, therefore, the slot, in the region where it joins the slideway, widens in the downstream direction. Preferably, all the slots are of substantially the same construction in the zone where they join their associated slideway.

Preferred embodiments of the invention will be described in greater detail hereinafter with reference to the accompanying drawings wherein:

LIST OF DRAWINGS

FIG. 1 is a section through a cascade or curtain coater constructed in accordance with this invention;

FIG. 2 is a view to an enlarged scale of the portion II of FIG. 1, and

FIGS. 3 and 4 are each a view of an alternative construction for a cascade coater.

Referring to FIG. 1, a cascade or curtain coater 1 comprises three supply lines 2, 3 and 4 for coating liquids three distributing ducts 5, 6 and 7 connected one each to a different line and extending over the full width of the apparatus, and three feed slots 8, 9 and 10 each communicating with a different one of the distributing ducts and each extending into a different one of the downwardly inclined slideways 11, 12 and 13.

The coating liquids are pumped into the distributing ducts from whence they issue through the slots on to the slideways, the liquids then flowing down the slideways in the form of thin coats or layers 14, 15 and 16 and finally falling in the form of a three-coat curtain or cascade 17 on to a base material (not shown) which is to be coated.

FIG. 2 is a larger scale view of the zone where the top feed slot 8 joins its associated slideway 11. Slot 8 has an upstream boundary wall 18 and a downstream boundary wall 19. Wall 18 cooperates with an upstream slideway 20, lying in a plane parallel to the plane of the slideway 11, to form a straight edge 21. Edge 21 is higher than the slideway 11 by a distance A of approximately 0.2 mm. The downstream boundary wall 19 has a face 22 so that the slot 8 widens in the downstream direction in the zone where it joins the slideway 11. The length L of the face 22 is approximately 1 mm as measured in a plane perpendicular to the slideway and to the downstream boundary wall in the direction of coating liquid flow, and angle $\alpha$ between the plane of slideway 11 and the plane of face 22 is approximately 120°.

The zones where the slots 9, 10 join their respective slideways are made in just the same way as for the slot 8.

Widening the zone in the downstream direction where the top slot joins its associated slideway makes it possible for the amount by which the upstream slot edge projects above the slideway to be very small or, and as can be seen in FIGS. 3 and 4, even to be omitted entirely without causing the coating liquid to spread out over the upstream slot edge. Instead, the coating liquid forms a satisfactory and welldefined wetting line or boundary at the slot edge. As experiments have shown, if the slot widening is dimensioned appropriately, even without the rear slot edge projecting above the slideway the amount of coating liquid flowing through the slot can be varied within wide limits (0.1 to 2.5 ml $cm^{-1}$ $sec^{-1}$) without the position of the wetting line altering.

In practice the angle $\alpha$ can be between approximately 100° and 170°; angles between 110° and 140° having proved very satisfactory. Values of approximately at least 0.5 mm, preferably at least approximately 1.0 mm, to approximately 5 mm have proved convenient for the face length L. The particular shape of the slot widening has basically little effect, but for reasons of production engineering a flat surface for the face 22 is probably best. However, and as shown in FIG. 3, the junction of the downstream slot boundary wall 19 with its associated slideway can be rounded as at 23, the radius R being at least 0.5 mm, preferably 1.0 mm and at most approximately 5.0 mm. The downstream widening of the slot may also be stepped or concave. The amount by which the upstream edge of the top slot is higher than its associated slideway, and the perpendicular separation between to consecutive slideways, should be approximately 0.5 mm or less. Preferably, the slideways and the upstream edge of the top slot are coplanar.

The embodiment shown partially in FIG. 4 comprises two identical feed slots 8', 9'. The liquid layers 14', 15' issuing from them each form an accurate wetting line at the upstream slot boundary edges 21', 21'' and flow smoothly over another. The only other difference between this embodiment and the embodiment of FIG. 1 is that the slots 8', 9' are perpendicular to the slideways.

Shaping the zones where the slots join their respective slideways as described above makes it unnecessary to make the top slots in a particular way. If, as shown in FIGS. 1 and 4, all or at least some of the slots are shaped as described, any slot that is so shaped can be used as the "top" slot — i.e., the cascade coater can be used without constructional changes to apply any number of layers up to the maximum number of which the coater is capable. Also, risk of damage to the slot wall boundary edges is reduced considerably by the reduction or elimination of the height difference between the slideways.

Shaping the regions where the slots meet their slideways is very expedient in combination with the multiduct distributing system disclosed in Swiss Pat. No. 530 032.

What is claimed is:

1. A cascade coater having at least one slideway and, extending thereinto, an associated feed slot having an upstream and a downstream boundary wall, the upstream boundary wall terminating in an edge parallel to the associated slideway, whereas the downstream boundary wall of the slot has a face between said boundary wall and the associated slideway at an angle of from approximately 100° to 170°, with the slideway and the face length as measured in a plane perpendicular to the slideway and to the downstream boundary wall being at least 0.5 mm and at most 5 mm.

2. A coater according to claim 1, wherein the face length is at least 1.0 mm.

3. A coater according to claim 1, wherein the distance between a plane in which said edge of the upstream boundary wall lies and a plane in which lies said associated slideway is at most 0.1 mm.

4. A coater according to claim 1, including at least two slideways with one feed slot each, the downstream boundary wall of each feed slot having a face between said boundary wall and the associated slideway.

* * * * *